US008244525B2

(12) United States Patent
Makinen

(10) Patent No.: US 8,244,525 B2
(45) Date of Patent: Aug. 14, 2012

(54) SIGNAL ENCODING A FRAME IN A COMMUNICATION SYSTEM

(75) Inventor: Jari M. Makinen, Tampere (FI)

(73) Assignee: Nokia Corporation, Espoo (FI)

( * ) Notice: Subject to any disclaimer, the term of this patent is extended or adjusted under 35 U.S.C. 154(b) by 679 days.

(21) Appl. No.: 10/993,492

(22) Filed: Nov. 22, 2004

(65) Prior Publication Data

US 2005/0240399 A1 Oct. 27, 2005

(30) Foreign Application Priority Data

Apr. 21, 2004 (GB) ..... 0408856.3

(51) Int. Cl.
*G10L 19/00* (2006.01)

(52) U.S. Cl. ..... 704/208; 704/200; 704/200.1; 704/201; 704/500; 704/501

(58) Field of Classification Search ..... 704/200.1, 704/201, 208, 214, 229, 233
See application file for complete search history.

(56) References Cited

U.S. PATENT DOCUMENTS

| | | | | |
|---|---|---|---|---|
| 5,623,575 | A * | 4/1997 | Fette et al. | 704/265 |
| 5,822,725 | A * | 10/1998 | Komatsu et al. | 704/226 |
| 5,991,716 | A * | 11/1999 | Lehtimaki | 704/212 |
| 6,633,841 | B1 * | 10/2003 | Thyssen et al. | 704/233 |
| 6,640,209 | B1 * | 10/2003 | Das | 704/219 |
| 6,658,383 | B2 * | 12/2003 | Koishida et al. | 704/229 |
| 6,785,645 | B2 * | 8/2004 | Khalil et al. | 704/216 |
| 7,043,428 | B2 * | 5/2006 | Li | 704/233 |
| 7,117,150 | B2 * | 10/2006 | Murashima | 704/233 |
| 7,120,576 | B2 * | 10/2006 | Gao | 704/208 |
| 7,139,700 | B1 * | 11/2006 | Stachurski et al. | 704/207 |
| 7,191,128 | B2 * | 3/2007 | Sall et al. | 704/233 |
| 2002/0188442 | A1 * | 12/2002 | Gass et al. | 704/208 |
| 2003/0004711 | A1 * | 1/2003 | Koishida et al. | 704/223 |
| 2003/0009325 | A1 | 1/2003 | Kirchherr et al. | |
| 2003/0182105 | A1 * | 9/2003 | Sall et al. | 704/206 |
| 2004/0098268 | A1 * | 5/2004 | Ha | 704/500 |

(Continued)

FOREIGN PATENT DOCUMENTS

EP 0 932 141 A2 7/1999

(Continued)

OTHER PUBLICATIONS

Tancerel, L.; Ragot, S.; Ruoppila, V.T.; Lefebvre, R.; , "Combined speech and audio coding by discrimination," Speech Coding, 2000. Proceedings. 2000 IEEE Workshop on , vol., no., pp. 154-156, 2000.*

(Continued)

*Primary Examiner* — Douglas Godbold
(74) *Attorney, Agent, or Firm* — Squire Sanders (US) LLP

(57) ABSTRACT

Embodiments of the invention provide a method and encoder for encoding a frame in of a communication system. The method includes calculating a first set of parameters associated with the frame, wherein said first set of parameters comprises filter bank parameters. The method further includes selecting, in a first stage, one of a plurality of encoding methods based on the first set of parameters one of modes for encoding, calculating a second set of parameters associated with the frame, selecting, in a second stage, one of the plurality of encoding methods based on the result of the first stage selection and the second set of parameters one of modes for encoding, and encoding the frame using the selected encoding excitation method from the second stage.

43 Claims, 3 Drawing Sheets

U.S. PATENT DOCUMENTS

2005/0075873 A1* 4/2005 Makinen ..... 704/230

FOREIGN PATENT DOCUMENTS

EP 1 278 184 A2 1/2003

OTHER PUBLICATIONS

Bessett, B. et al., "*A Wideband Speech and Audio Codec at 16/24/32 KBIT/S Using Hybrid ACELP/TCX Techniques*", Speech Coding Proceedings, IEEE Workshop on Porvoo, Finland, Jun. 20-23, 1999, pp. 7-9.

Makinen, J., "*Source Signal Based Rate Adaptation for GSM AMR Speech Codec*", Information Technology Coding and Computing, 2004. Proceedings, ITCC 2004, Apr. 5, 2004, 6 pages.

* cited by examiner 4.8 - 6.4 kHz
4.0 - 4.8 kHz
3.2 - 4.0 kHz
2.4 - 3.2 kHz
2.0 - 2.4 kHz
1.6 - 2.0 kHz
1.2 - 1.6 kHz
0.8 - 1.2 kHz
0.6 - 0.8 kHz
0.4 - 0.6 kHz
0.2 - 0.4 kHz
0.0 - 0.2 kHz
322
324
326
328
330
332
334
336
338
340
342
344
3rd order filter block
306
5th order filter block
310
3rd order filter block
312
3rd order filter block
314
3rd order filter block
316
3rd order filter block
318
3rd order filter block
320
5th order filter block
313
5th order filter block
304
5th order filter block
308
5th order filter block
302
301
300

SIGNAL ENCODING A FRAME IN A COMMUNICATION SYSTEM

FIELD OF INVENTION

The present invention relates to a method for encoding a signal in an encoder of a communication system.

BACKGROUND TO THE INVENTION

Cellular communication systems are commonplace today. Cellular communication systems typically operate in accordance with a given standard or specification. For example, the standard or specification may define the communication protocols and/or parameters that shall be used for a connection. Examples of the different standards and/or specifications include, without limiting to these, GSM (Global System for Mobile communications), GSM/EDGE (Enhanced Data rates for GSM Evolution), AMPS (American Mobile Phone System), WCDMA (Wideband Code Division Multiple Access) or 3rd generation (3G) UMTS (Universal Mobile Telecommunications System), IMT 2000 (International Mobile Telecommunications 2000) and so on.

In a cellular communications system and in general signal processing applications, a signal is often compressed to reduce the amount of information needed to represent the signal. For example, an audio signal is typically captured as an analogue signal, digitised in an analogue to digital (A/D) converter and then encoded. In a cellular communication system, the encoded signal can be transmitted over the wireless air interface between a user equipment, such as a mobile terminal, and a base station. Alternatively, as in a more general signal processing systems, the encoded audio signal can be stored in a storage medium for later use or reproduction of the audio signal.

The encoding compresses the signal and, as in a cellular communication system, can then be transmitted over the air interface with the minimum amount of data whilst maintaining an acceptable signal quality level. This is particularly important as radio channel capacity over the wireless air interface is limited in a cellular communication system.

An ideal encoding method will encode the audio signal in as few bits as possible thereby optimising channel capacity, while producing a decoded signal that sounds as close to the original audio as possible. In practice there is usually a trade-off between the bit rate of the compression method and the quality of the decoded speech.

The compression or encoding can be lossy or lossless. In lossy compression some information is lost during the compression where it is not possible to fully reconstruct the original signal from the compressed signal. In lossless compression no information is normally lost and the original signal can be fully reconstructed from the compressed signal.

An audio signal can be considered as a signal containing speech, music (or non-speech) or both. The different characteristics of speech and music make it difficult to design a single encoding method that works well for both speech and music. Often an encoding method that is optimal for speech signals is not optimal for music or non-speech signals. Therefore, to solve this problem, different encoding methods have been developed for encoding speech and music. However, the audio signal must be classified as speech or music before an appropriate encoding method can be selected.

Classifying an audio signal as either a speech signal or music/non-speech signal is a difficult task. The required accuracy of the classification depends on the application using the signal. In some applications the accuracy is more critical like in speech recognition or in archiving for storage and retrieval purposes.

However, it is possible that an encoding method for parts of the audio signal comprising mainly of speech is also very efficient for parts comprising mainly of music. Indeed, it is possible that an encoding method for music with strong tonal components may be very suitable for speech. Therefore, methods for classifying an audio signal based purely on whether the signal is made up of speech or music does not necessarily result in the selection of the optimal compression method for the audio signal.

The adaptive multi-rate (AMR) codec is an encoding method developed by the 3$^{rd}$ Generation Partnership Project (3GPP) for GSM/EDGE and WCDMA communication networks. In addition, it has also been envisaged that AMR will be used in future packet switched networks. AMR is based on Algebraic Code Excited Linear Prediction (ACELP) excitation encoding. The AMR and adaptive multi-rate wideband (AMR-WB) codecs consist of 8 and 9 active bit rates respectively and also includes voice inactivity detection (VAD) and discontinuous transmission (DTX) functionality. The sampling rate in the AMR codec is 8 kHz. In the AMR WB codec the sampling rate is 16 kHz.

Details of the AMR and AMR-WB codecs can be found in the 3GPP TS 26.090 and 3GPP TS 26.190 technical specifications. Further details of the AMR-WB codec and VAD can be found in the 3GPP TS 26.194 technical specification.

In another encoding method, the extended AMR-WB (AMR-WB+) codec, the encoding is based on two different excitation methods: ACELP pulse-like excitation and transform coded (TCX) excitation. The ACELP excitation is the same as that used already in the original AMR-WB codec. TCX excitation is an AMR-WB+ specific modification.

ACELP excitation encoding operates using a model of how a signal is generated at the source, and extracts from the signal the parameters of the model. More specifically, ACELP encoding is based on a model of the human vocal system, where the throat and mouth are modelled as a linear filter and a signal is generated by a periodic vibration of air exciting the filter. The signal is analysed on a frame by frame basis by the encoder and for each frame a set of parameters representing the modelled signal is generated and output by the encoder. The set of parameters may include excitation parameters and the coefficients for the filter as well as other parameters. The output from an encoder of this type is often referred to as a parametric representation of the input signal. The set of parameters is used by a suitably configured decoder to regenerate the input signal.

In the AMR-WB+ codec, linear prediction coding (LPC) is calculated in each frame of the signal to model the spectral envelope of the signal as a linear filter. The result of the LPC, known as the LPC excitation, is then encoded using ACELP excitation or TCX excitation.

Typically, ACELP excitation utilises long term predictors and fixed codebook parameters, whereas TCX excitation utilises Fast Fourier Transforms (FFTs). Furthermore, in the AMR-WB+ codec the TCX excitation can be performed using one of three different frame lengths (20, 40 and 80 ms).

TCX excitation is widely used in non-speech audio encoding. The superiority of TCX excitation based encoding for non-speech signals is due to the use of perceptual masking and frequency domain coding. Even though TCX techniques provide superior quality music signals, the quality is not so good for periodic speech signals. Conversely, codecs based on the human speech production system such as ACELP, provide superior quality speech signals but poor quality music signals.

Therefore, in general, ACELP excitation is mostly used for encoding speech signals and TCX excitation is mostly used for encoding music and other non-speech signals. However, this is not always the case, as sometimes a speech signal has parts that are music like and a music signal has parts that are speech like. There also exists audio signals that contain both music and speech where the selected encoding method based solely on one of ACELP excitation or TCX excitation may not be optimal.

The selection of excitation in AMR-WB+ can be done in several ways.

The first and simplest method is to analyse the signal properties once before encoding the signal, thereby classifying the signal into speech or music/non-speech and selecting the best excitation out of ACELP and TCX for the type of signal. This is known as a "pre-selection" method. However, such a method is not suited to a signal that has varying characteristics of both speech and music, resulting in an encoded signal that is neither optimised for speech or music.

The more complex method is to encode the audio signal using both ACELP and TCX excitation and then select the excitation based on the synthesised audio signal which is of a better quality. The signal quality can be measured using a signal-to-noise type of algorithm. This "analysis-by-synthesis" type of method, also known as the "brute-force" method as all different excitations are calculated and the best one selected, provides good results but it is not practical because of the computational complexity of performing multiple calculations.

It is the aim of embodiments of the present invention to provide an improved method for selecting an excitation method for encoding a signal that at least partly mitigates some of the above problems.

SUMMARY OF THE INVENTION

In accordance with a first aspect of the present invention there is provided a method for encoding a frame in an encoder of a communication system, said method comprising the steps of: calculating a first set of parameters associated with the frame, wherein said first set of parameters comprises filter bank parameters; selecting, in a first stage, one of a plurality of encoding methods based on predetermined conditions associated with the first set of parameters; calculating a second set of parameters associated with the frame; selecting, in a second stage, one of the plurality of encoding methods based on the result of the first stage selection and the second set of parameters; and encoding the frame using the selected encoding method from the second stage.

Preferably, the plurality of encoding methods comprises a first excitation method and a second excitation method.

The first set of parameters may be based on energy levels of one or more frequency bands associated with the frame. And for different predetermined conditions of said first set of parameters, no encoding method may be selected at the first stage.

The second set of parameters may comprise at least one of spectral parameters, LTP parameters and correlation parameters associated with the frame.

Preferably, the first excitation method is algebraic code excited linear prediction excitation and the second excitation method is transform coding excitation.

When the frame is encoded using the second excitation method, the method for encoding may further comprise selecting the length of the frame encoded using the second excitation method based on the selecting at the first stage and the second stage.

The selection of the length of the encoded frame may be dependent on the signal to noise ratio of the frame.

Preferably, the encoder is an AMR-WB+ encoder.

The frame may be an audio frame. Preferably, the audio frame comprises speech or non-speech. The non-speech may comprise music.

In accordance with another aspect of the present invention there is provided an encoder for encoding a frame in a communication system, said encoder comprising: a first calculation module adapted to calculate a first set of parameters associated with the frame, wherein said first set of parameters comprises filter bank parameters; a first stage selection module adapted to select one of a plurality of encoding methods based on the first set of parameters; a second calculation module adapted to calculate a second set of parameters associated with the frame; a second stage selection module adapted to select one of the plurality of encoding methods based on the result of the first stage selection and the second set of parameters; and an encoding module adapted to encode the frame using the selected encoding method from the second stage.

According to a further aspect of the present invention, there is provided a method for encoding a frame in an encoder of a communication system, said method comprising the steps of: calculating a first set of parameters associated with the frame, wherein said first set of parameters comprises filter bank parameters; selecting, in a first stage, one of a first excitation method or second excitation method based on the first set of parameters; encoding the frame using the selected excitation method.

BRIEF DESCRIPTION OF DRAWINGS

For a better understanding of the present invention reference will now be made by way of example only to the accompanying drawings, in which.

DETAILED DESCRIPTION OF EMBODIMENTS

The present invention is described herein with reference to particular examples. The invention is not, however, limited to such examples.

Figure 1:
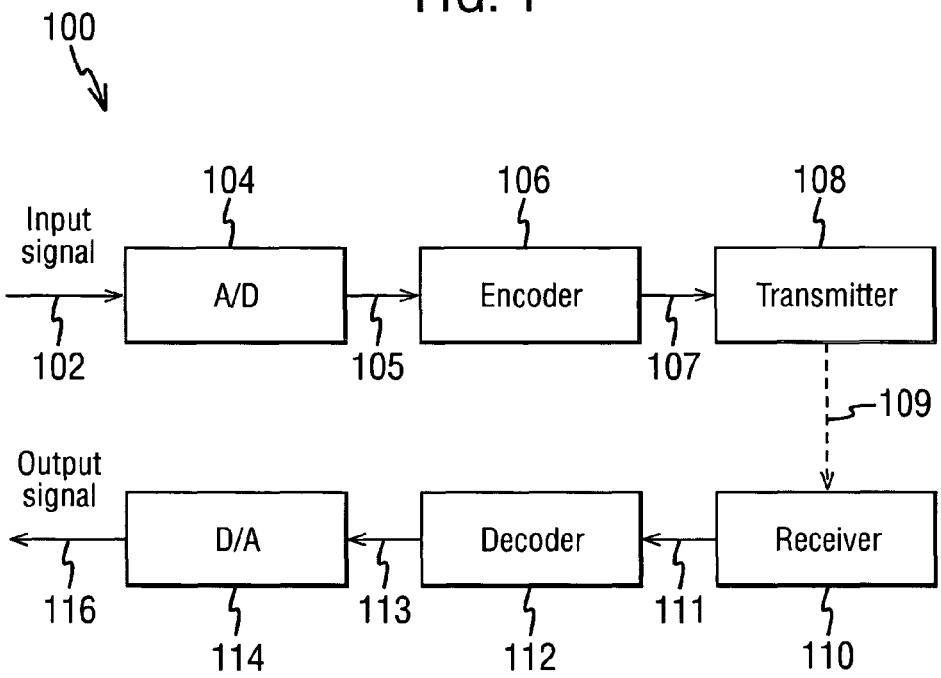
FIG. 1 illustrates a communication network in which embodiments of the present invention can be applied.

FIG. 1 illustrates a communications system 100 that supports signal processing using the AMR-WB+ codec according to one embodiment of the invention.

The system 100 comprises various elements including an analogue to digital (A/D) converter 104, and encoder 106, a transmitter 108, a receiver 110, a decoder 112 and a digital to analogue (D/A) converter 114. The A/D converter 104, encoder 106 and transmitter 108 may form part of a mobile terminal. The receiver 110, decoder 112 and D/A converter 114 may form part of a base station.

The system 100 also comprises one or more audio sources, such as a microphone not shown in FIG. 1, producing an audio signal 102 comprising speech and/or non-speech signals. The analogue signal 102 is received at the A/D converter 104, which converts the analogue signal 102 into a digital signal 105. It should be appreciated that if the audio source produces a digital signal instead of an analogue signal, then the A/D converter 104 is bypassed.

The digital signal 105 is input to the encoder 106 in which encoding is performed to encode and compress the digital signal 105 on a frame-by-frame basis using a selected encoding method to generate encoded frames 107. The encoder may operate using the AMR-WB+ codec or other suitable codec and will be described in more detail hereinbelow.

The encoded frames can be stored in a suitable storage medium to be processed later, such as in a digital voice recorder. Alternatively, and as illustrated in FIG. 1, the encoded frames are input into the transmitter 108, which transmits the encoded frames 109.

The encoded frames 109 are received by the receiver 110, which processes them and inputs the encoded frames 111 into the decoder 112. The decoder 112 decodes and decompresses the encoded frames 111. The decoder 112 also comprises determination means to determine the specific encoding method used in the encoder for each encoded frame 111 received. The decoder 112 selects on the basis of the determination a decoding method for decoding the encoded frame 111.

The decoded frames are output by the decoder 112 in the form of a decoded signal 113, which is input into the D/A converter 114 for converting the decoded signal 113, which is a digital signal, into an analogue signal 116. The analogue signal 116 may then be processed accordingly, such as transforming into audio via a loudspeaker.

Figure 2:
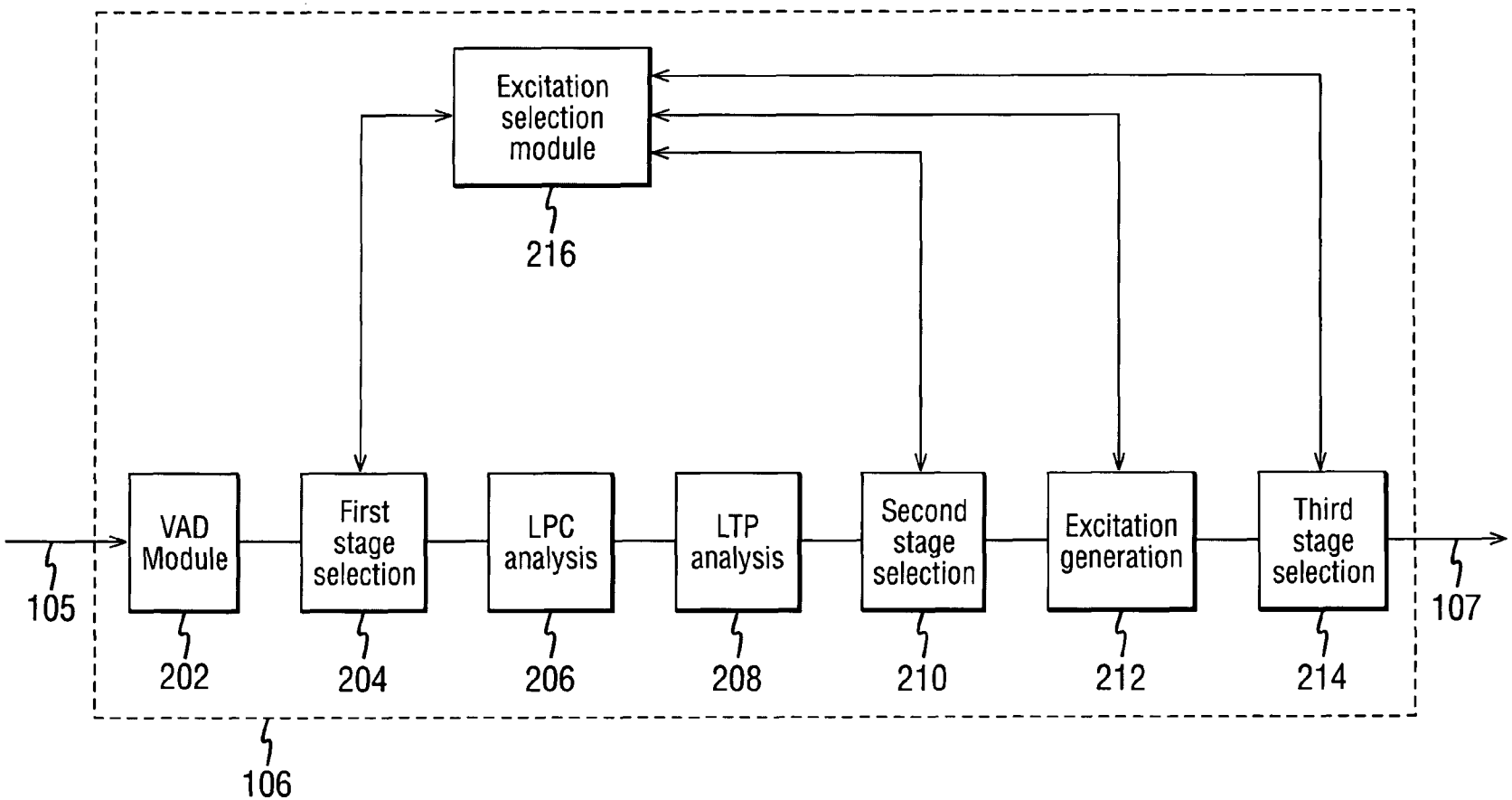
FIG. 2 illustrates a block diagram of an embodiment of the present invention.

FIG. 2 illustrates a block diagram of the encoder 106 of FIG. 1 in a preferred embodiment of the present invention. The encoder 106 operates according to the AMR-WB+ codec and selects one of ACELP excitation or TCX excitation for encoding a signal. The selection is based on determining the best coding model for the input signal by analysing parameters generated in the encoder modules.

The encoder 106 comprises a voice activity detection (VAD) module 202, a linear prediction coding (LPC) analysis module 206, a long term prediction (LTP) analysis module 208 and an excitation generation module 212. The excitation generation module 212 encodes the signal using one of ACELP excitation or TCX excitation.

The encoder 116 also comprises an excitation selection module 216, which is connected to a first stage selection module 204, a second stage selection module 210 and a third stage selection module 214. The excitation selection module 216 determines the excitation method, ACELP excitation or TCX excitation, used by the excitation generation module 212 to encode the signal.

The first stage selection module 204 is connected the between the VAD module 202 and the LPC analysis module 206. The second stage selection module 210 is connected between the LTP analysis module 208 and excitation generation module 212. The third stage selection module 214 is connected to the excitation generation module 212 and the output of the encoder 106.

The encoder 106 receives an input signal 105 at the VAD module, which determines whether the input signal 105 comprises active audio or silence periods. The signal is transmitted onto the LPC analysis module 206 and is processed on a frame by frame basis.

The VAD module also calculates filter band values which can be used for excitation selection. During a silence period, excitation selection states are not updated for the duration of the silence period.

The excitation selection module 216 determines a first excitation method in the first stage selection module 204. The first excitation method is one of ACELP excitation or TCX excitation and is to be used to encode the signal in the excitation generation module 212. If an excitation method cannot be determined in the first stage selection module 204, it is left undefined.

This first excitation method determined by the excitation selection module 216 is based on parameters received from the VAD module 202. In particular, the input signal 105 is divided by the VAD module 202 into multiple-frequency bands, where the signal in each frequency band has an associated energy level. The frequency bands and the associated energy levels are received by the first stage selection module 204 and passed to the excitation selection module 216, where they are analysed to classify the signal generally as speech like or music like using a first excitation selection method.

The first excitation selection method may include analysing the relationship between the lower and higher frequency bands of the signal together with the energy level variations in those bands. Different analysis windows and decision thresholds may also be used in the analysis by the excitation selection module 216. Other parameters associated with the signal may also be used in the analysis.

Figure 3:
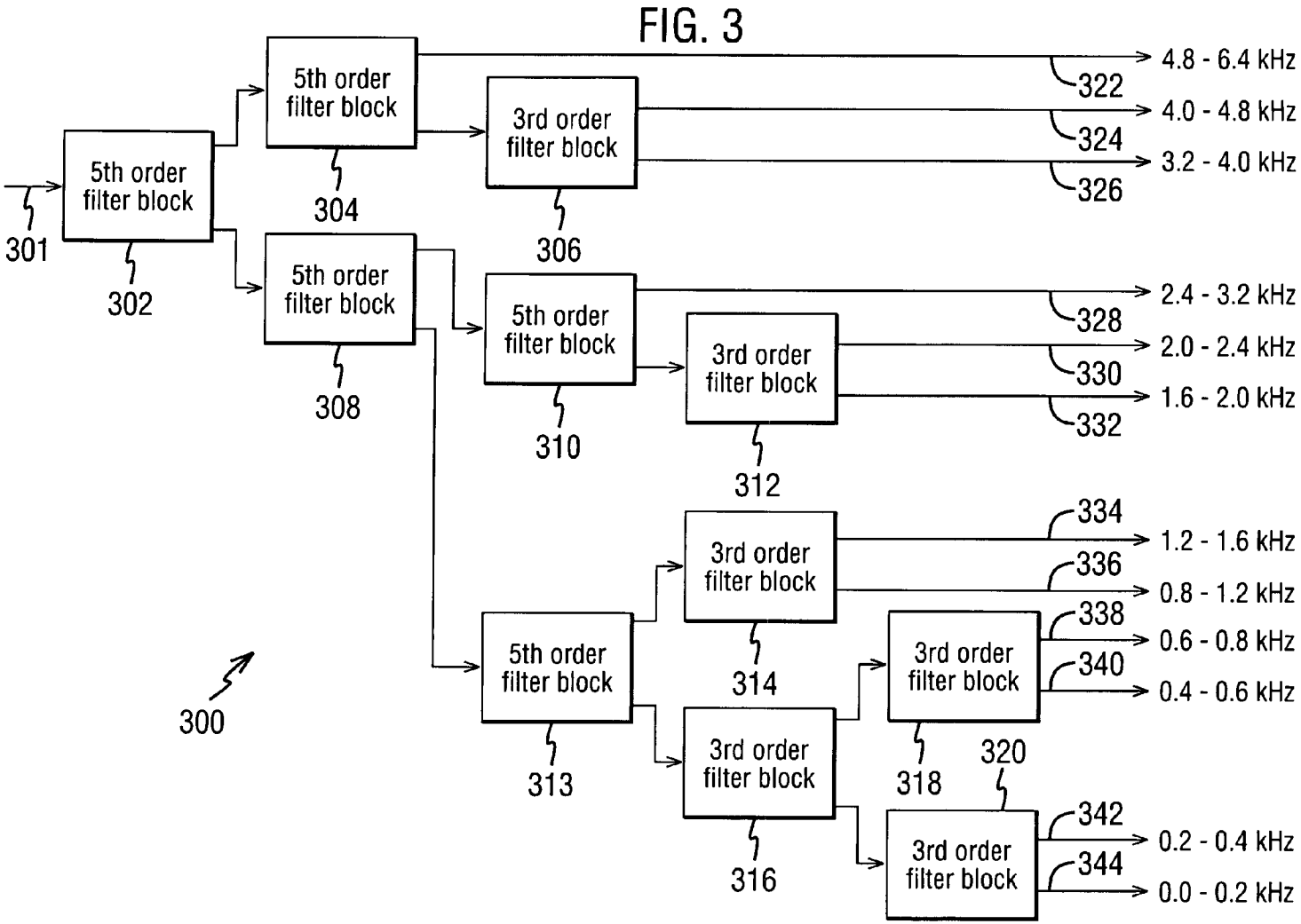
FIG. 3 a VAD filter bank structure in an embodiment of the present invention.

An example of a filter bank 300 utilised by the VAD module 202 generating different frequency bands is illustrated in FIG. 3. The energy levels associated with each frequency band are generated by statistical analysis. The filter bank structure 300 includes $3^{rd}$ order filter blocks 306, 312, 314, 316, 318 and 320. The filter bank 300 further includes $5^{th}$ order filter blocks 302, 304, 308, 310 and 313. The "order" of a filter block is the maximum delay, in terms of the number of samples, used to create each output sample. For example, $y(n)=a*x(n)+b*x(n-1)+c*x(n-2)+d*x(n-3)$ specifies an instance of a $3^{rd}$ order filter.

A signal 301 is input into the filter bank and processed by a series of the $3^{rd}$ and/or $5^{th}$ order filter blocks resulting in the filtered signal bands 4.8 to 6.4 kHz 322, 4.0 to 4.8 kHz 324, 3.2 to 4.0 kHz 326, 2.4 to 3.2 kHz 328, 2.0 to 2.4 kHz 330, 1.6 to 2.0 kHz 332, 1.2 to 1.6 kHz 334, 0.8 to 1.2 kHz 336, 0.6 to 0.8 kHz 338, 0.4 to 0.6 kHz 340, 0.2 to 0.4 kHz 342, 0.0 to 0.2 kHz 344.

The filtered signal band 4.8 to 6.4 kHz 322 is generated by passing the signal through $5^{th}$ order filter block 302 followed by $5^{th}$ order filter block 304. The filtered signal band 4.0 to 4.8 kHz 324 is generated by passing the signal through $5^{th}$ order filter block 302 followed by $5^{th}$ order filter block 304 and $3^{rd}$ order filter block 306. The filtered signal band 3.2 to 4.0 kHz 326 is generated by passing the signal through $5^{th}$ order filter block 302 followed by $5^{th}$ order filter block 304 and $3^{rd}$ order filter block 306. The filtered signal band 2.4 to 3.2 kHz 330 is generated by passing the signal through $5^{th}$ order filter block 302 followed by $5^{th}$ order filter block 308 and $5^{th}$ order filter block 310. The filtered signal band 2.0 to 2.4 kHz 330 is generated by passing the signal through $5^{th}$ order filter block 302 followed by $5^{th}$ order filter block 308, $5^{th}$ order filter block 310 and $3^{rd}$ order filter block 312. The filtered signal band 1.6 to 2.0 kHz 332 is generated by passing the signal through $5^{th}$ order filter block 302 followed by $5^{th}$ order filter block 308, $5^{th}$ order filter block 310 and $3^{rd}$ order filter block 312. The filtered signal band 1.2 to 1.6 kHz 334 is generated by passing the signal through $5^{th}$ order filter block 302 followed by $5^{th}$ order filter block 308, $5^{th}$ order filter block 313 and $3^{rd}$ order filter block 314. The filtered signal band 0.8 to 1.2 kHz 336 is generated by passing the signal through $5^{th}$ order filter block 302 followed by $5^{th}$ order filter block 308, $5^{th}$ order filter block 313 and $3^{rd}$ order filter block 314. The filtered signal band 0.6 to 0.8 kHz 338 is generated by passing the signal through $5^{th}$ order filter block 302 followed by $5^{th}$ order filter block 308, $5^{th}$ order filter block 313, $3^{rd}$ order filter block 316 and $3^{rd}$ order filter block 318. The filtered signal band 0.4 to 0.6 kHz 340 is generated by passing the signal through $5^{th}$ order filter block 302 followed by $5^{th}$ order filter block 308, $5^{th}$ order filter block 313, $3^{rd}$ order filter block 316 and $3^{rd}$ order filter block 318. The filtered signal band 0.2 to 0.4 kHz 342 is generated by passing the signal through $5^{th}$ order filter block 302 followed by $5^{th}$ order filter block 308, $5^{th}$ order filter block 313, $3^{rd}$ order filter block 316 and $3^{rd}$ order filter block 320. The filtered signal band 0.0 to 0.2 kHz 344 is generated by passing the signal through $5^{th}$ order filter block 302 followed by $5^{th}$ order filter block 308, $5^{th}$ order filter block 313, $3^{rd}$ order filter block 316 and $3^{rd}$ order filter block 320.

The analysis of the parameters by the excitation selection module 216 and, in particular, the resulting classification of the signal is used to select a first excitation method, one of ACELP or TCX, for encoding the signal in the excitation generation module 212. However, if the analysed signal does not result in a classification of the signal as clearly speech like or music like, for example, when the signal has characteristics of speech and music, no excitation method is selected or is selected as uncertain and the selection decision is left until a later method selection stage. For example, the specific selection can be made at the second stage selection module 210 after LPC and LTP analysis.

The following is an example of a first excitation selection method used to select an excitation method.

The AMR-WB codec utilises the AMR-WB VAD filter banks in determining an excitation method, wherein for each 20 ms input frame, signal energy E(n) in each of the 12 subbands over the frequency range from 0 to 6400 Hz is determined. The energy levels of each subbands can be normalised by dividing the energy level E(n) from each subband by the width of that subband (in Hz) producing normalised EN(n) energy levels of each band.

In the first stage excitation selection module 204 the standard deviation of the energy levels can be calculated for each of the 12 subbands using two windows: a short window stdshort(n) and a long window stdlong(n). In the case of AMR-WB+, the length of the short window is 4 frames and the long window is 16 frames. Using this algorithm, the 12 energy levels from the current frame together with the 12 energy levels from the previous 3 or 15 frames (resulting in 4 and 16 frame windows) are used to derive the two standard deviation values. One feature of this calculation is that it is only performed when VAD module 202 determines that the input signal 105 comprises active audio. This allows the algorithm to react more accurately after prolonged periods of speech/music pauses, when statistical parameters may be distorted.

Then, for each frame, the average standard deviation over all the 12 subbands are calculated for both the long and short windows and the average standard deviation values of stdalong and stdashort are also calculated.

For each frame of the audio signal, a relationship between the lower frequency bands and the higher frequency bands can be calculated. In AMR-WB+, LevL is calculated by taking the sum of the energy levels of lower frequency subbands, from 2 to 8, and normalising by dividing the sum by the total length (bandwidth) of these subbands (in Hz). For the higher frequency subbands from 9 to 12, the sum of the energy levels of these subbands is calculated and normalised to give LevH. In this example, the lowest subband 1 is not used in the calculations because it usually contains a disproportionate amount of energy that would distort the calculations and make the contributions from other subbands too small. From these measurements the relationship LPH is determined given by:

$$LPH = \mathrm{Lev}L/\mathrm{Lev}H$$

In addition, for each frame a moving average LPHa is calculated using the current and the 3 previous LPH values. A low and high frequency relationship LPHaF for the current frame is also calculated based on the weighted sum of the current and 7 previous moving average LPHa values where the more recent values are given more weighting.

The average energy level AVL of the filter blocks for the current frame is calculated by subtracting the estimated energy level of the background noise from each filter block output, and then summing the result of each of the subtracted energy levels multiplied by the highest frequency of the corresponding filter block. This balances the high frequency subbands containing relatively less energy compared with the lower frequency, higher energy subbands.

The total energy of the current frame TotE0 is calculated by taking the combined energy levels from all the filter blocks and subtracting the background noise estimate of each filter bank.

After making the above calculations, a choice between the ACELP and TCX excitation methods can be made using the following method, where it is assumed that when a given flag is set, the other flags are cleared to prevent conflicts in settings.

First, the average standard deviation value for the long window stdalong is compared with a first threshold value TH1, for example 0.4. If the standard deviation value stdalong is smaller than the first threshold value TH1, a TCX MODE flag is set to indicate selection of TCX excitation for encoding. Otherwise, the calculated measurement of the low and high frequency relationship LPHaF is compared with a second threshold value TH2, for example 280.

If the calculated measurement of the low and high frequency relationship LPHaF is greater than the second threshold value TH2, the TCX MODE flag is set. Otherwise, an inverse of the standard deviation value stdalong minus the first threshold value TH1 is calculated and a first constant C1, for example 5, is summed with the subtracted inverse value. The sum is compared with the calculated measurement of the low and high frequency relationship LPHaF as follows:

$$C1+(1/(\mathrm{stdalong}-TH1))>LPHaF \quad (1)$$

If the result of the comparison (1) is true, the TCX MODE flag is set to indicate selection of TCX excitation for encoding. If the result of the comparison is not true, the standard deviation value stdalong is multiplied by a first multiplicand M1 (e.g. −90) and a second constant C2 (e.g. 120) is added to the result of the multiplication. The sum is compared with the calculated measurement of the low and high frequency relationship LPHaF as follows:

$$(M1*\mathrm{stdalong})+C2<LPHaF \quad (2)$$

If the sum is smaller than the calculated measurement of the low and high frequency relation LPHaF, in other words if the result of comparison (2) is true, an ACELP MODE flag is set to indicate selection of ACELP excitation for encoding. Otherwise an UNCERTAIN MODE flag is set indicating that the excitation method could not yet be determined for the current frame.

A further examination can then be performed before the selection of excitation method for the current frame is confirmed.

The further examination first determines whether either the ACELP MODE flag or the UNCERTAIN MODE flag is set. If either is set and if the calculated average level AVL of the filter banks for the current frame is greater than a third threshold value TH3 (e.g. 2000), then the TCX MODE flag is set instead and the ACELP MODE flag and the UNCERTAIN MODE flag are cleared.

Next, if the UNCERTAIN MODE flag remains set, similar calculations are performed for the average standard deviation value stdashort for the short window to those described above for the average standard deviation value stdalong for the long window, but using slightly different values for the constants and thresholds in the comparisons.

If the average standard deviation value stdashort for the short window is smaller than a fourth threshold value TH4 (e.g. 0.2), the TCX MODE flag is set to indicate selection of TCX excitation for encoding. Otherwise, an inverse of the standard deviation value stdashort for the short window minus the fourth threshold value TH4 is calculated and a third constant C3 (e.g. 2.5) is summed to the subtracted inverse value. The sum is compared with the calculated measurement of the low and high frequency relationship LPHaF as follows:

$$C3+(1/(\text{stdashort}-TH4))>LPHaF \quad (3)$$

If the result of the comparison (3) is true, the TCX MODE flag is set to indicate selection of TCX excitation for encoding. If the result of the comparison is not true, the standard deviation value stdashort is multiplied by a second multiplicand M2 (e.g. −90) and a fourth constant C4 (e.g. 140) is added to the result of the multiplication. The sum is compared with the calculated measurement of the low and high frequency relationship LPHaF as follows:

$$M2*\text{stdashort}+C4<LPHaF \quad (4)$$

If the sum is smaller than the calculated measurement of the low and high frequency relationship LPHaF, in other words if the result of comparison (4) is true, the ACELP MODE flag is set to indicate selection of ACELP excitation for encoding. Otherwise the UNCERTAIN MODE flag is set indicating that the excitation method could not yet be determined for the current frame.

In a next stage, the energy levels of the current frame and the previous frame can be examined. If the energy between the total energy of the current frame TotE0 and the total energy of the previous frame TotE-1 is greater than a fifth threshold value TH5 (e.g. 25) the ACELP MODE flag is set and the TCX MODE flag and the UNCERTAIN MODE flag are cleared.

Finally, if the TCX MODE flag or the UNCERTAIN MODE flag is set and if the calculated average level AVL of the filter banks 300 for the current frame is greater than the third threshold value TH3 and the total energy of the current frame TotE0 is less than a sixth threshold value TH6 (e.g. 60), the ACELP MODE flag is set.

When the above described first excitation selection method is performed, the first excitation method of TCX is selected in the first excitation block 204 when the TCX MODE flag is set or the second excitation method of ACELP is selected in the in the first excitation block 204 when the ACELP MODE flag is set. However, if the UNCERTAIN MODE flag is set, the first excitation selection method has not determined a excitation method. In this case, either ACELP or TCX excitation is selected in another excitation selection block(s), such as the second stage selection module 210 where further analysis can be performed to determine which of ACELP or TCX excitation to use.

The above described first excitation selection method can be illustrated by the following pseudo-code:

```
if (stdalong < TH1)
   SET TCX_MODE
else if (LPHaF > TH2)
   SET TCX_MODE
else if ((C1+(1/( stdalong −TH1))) > LPHaF)
      SET TCX_MODE
   else if ((M1* stdalong +C2) < LPHaF)
      SET ACELP_MODE
   else
      SET UNCERTAIN_MODE
if (ACELP_MODE or UNCERTAIN_MODE) and (AVL > TH3)
   SET TCX_MODE
if (UNCERTAIN_MODE)
   if (stdashort < TH4)
      SET TCX_MODE
   else        if ((C3+(1/( stdashort −TH4))) > LPHaF)
                  SET TCX_MODE
      else if ((M2* stdashort+C4) < LPHaF)
                  SET ACELP_MODE
      else
                  SET UNCERTAIN_MODE
if (UNCERTAIN_MODE)
   if ((TotE0 / TotE−1)>TH5)
      SET ACELP_MODE
if (TCX_MODE || UNCERTAIN_MODE))
   if (AVL > TH3 and TotE0 < TH6)
      SET ACELP_MODE
```

After the first stage selection module 204 has completed the above method and selected a first excitation method for encoding the signal, the signal is transmitted onto the LPC analysis module 206 from the VAD module 202, which processes the signal on a frame by frame basis.

Specifically, the LPC analysis module 206 determines an LPC filter corresponding to the frame by minimising the residual error of the frame. Once the LPC filter has been determined, it can be represented by a set of LPC filter coefficients for the filter. The frame processed by the LPC analysis module 206 together with any parameters determined by the LPC analysis module, such as the LPC filter coefficients, are transmitted onto the LTP analysis module 208.

The LTP analysis module 208 processes the received frame and parameters. In particular, the LTP analysis module calculates an LTP parameter, which is closely related to the fundamental frequency of the frame and is often referred to as a "pitch-lag" parameter or "pitch delay" parameter, which describes the periodicity of the speech signal in terms of speech samples. Another parameter calculated by the LTP analysis module 208 is the LTP gain and is closely related to the fundamental periodicity of the speech signal.

The frame processed by the LTP analysis module 208 is transmitted together with the calculated parameters to the excitation generation module 212, wherein frame is encoded using one of the ACELP or TCX excitation methods. The selection of one of the ACELP or TCX excitation methods is made by the excitation selection module 216 in conjunction with the second stage selection module 210.

The second stage selection module 210 receives the frame processed by the LTP analysis module 208 together with the parameters calculated by the LPC analysis module 206 and the LTP analysis module 208. These parameters are analysed by excitation selection module 216 to determine the optimal excitation method based on LPC and LTP parameters and normalised correlation from ACELP excitation and TCX excitation, to use for the current frame. In particular, the excitation selection module 216 analyses the parameters from the LPC analysis module 206 and particularly the LTP analysis module 208 and correlation parameters to select the optimal excitation method from ACELP excitation and TCX excitation. The second stage selection module verifies the first excitation method determined by the first stage selection module or, if the first excitation method was determined as uncertain by the first excitation selection method, the excitation selection module 210 selects the optimal excitation method at this stage. Consequently, the selection of an excitation method for encoding a frame is delayed until after LTP analysis has been performed.

Normalised correlation can be used in the second stage selection module and can be calculated as follows:

$$NormCorr = \sum_{i=1}^{N} \frac{x_{i-T0} * x_i}{\sqrt{x_{i-T0}} * \sqrt{x_i}},$$

where the frame length is N, T0 is the open-loop lag of the frame having a length N, $X_i$ is the ith sample of the encoded frame, $X_i-T0$ is the sample from an encoded frame that is T0 samples removed from the sample $x_i$.

There are also some exceptions in the second stage excitation selection, where first stage excitation selection of ACELP or TCX can be changed or reselected.

In a stable signal, where the difference between the minimum and maximum lag values of current and previous frames is below a predetermined threshold TH2, the lag may not change much between current and previous frames. In AMR-WB+, the range of LTP gain is typically between 0 and 1.2. The range of the normalised correlation is typically between 0 and 1.0. As an example, the threshold indicating high LTP gain could be over 0.8. High correlation (or similarity) of the LTP gain and normalised correlation can be observed by examining their difference. If the difference is below a third threshold, for example, 0.1 in the current and/or past frames, LTP gain and normalised correlation are considered to have a high correlation.

If the signal is transient in nature, it can be coded using a first excitation method, for example, by ACELP, in an embodiment of the present invention. Transient sequences can be detected by using spectral distance SD of adjacent frames. For example, if spectral distance, $SD_n$, of the frame n calculated from immittance spectrum pair (ISP) coefficients in current and previous frames exceeds a predetermined first threshold, the signal is classified as transient. ISP coefficients are derived from LPC filter coefficients that have been converted into the ISP representation.

Noise like sequences can be coded using a second excitation method, for example, by TCX excitation. These sequences can be detected by examining LTP parameters and the average frequency along the frame in the frequency domain. If the LTP parameters are very unstable and/or average frequency exceeds a predetermined threshold, the frame is determined as containing a noise like signal.

An example of an algorithm that can be used in the second excitation selection method is described as follows.

If VAD flag is set, denoting an active audio signal, and the first excitation method has been determined in the first stage selection module as uncertain (defined as TCX_OR_ACELP for example), the second excitation method can be selected as follows:

```
If (SD_n > 0.2)
   Mode = ACELP_MODE;
else
   if (LagDif_buf < 2 )
```

-continued

```
      if (Lag_n == HIGH LIMIT or Lag_n == LOW LIMIT){
         if (Gain_n−NormCorr_n<0.1 and NormCorr_n>0.9)
            Mode = ACELP_MODE
         else
            Mode = TCX_MODE
      else if (Gain_n− NormCorr_n < 0.1 and NormCorr_n > 0.88)
         Mode = ACELP_MODE
      else if (Gain_n − NormCorr_n > 0.2)
         Mode = TCX_MODE
      else
         NoMtcx = NoMtcx +1
   if (MaxEnergy_buf < 60 )
      if (SD_n > 0.15)
         Mode = ACELP_MODE;
      else
         NoMtcx = NoMtcx +1.
```

The spectral distance, $SD_n$, of the frame n is calculated from ISP parameters as follows:

$$SD(n) = \sum_{i=0}^{N} |ISP_n(i) - ISP_{n-1}(i)|,$$

where $ISP_n$ is the ISP coefficients vector of the frame n and $ISP_n(i)$ is ith element of it.

$LagDif_{buf}$ is the buffer containing open loop lag values of the previous ten frames (20 ms).

$Lag_n$ contains two open loop lag values of the current frame n.

$Gain_n$ contains two LTP gain values of the current frame n.

$NormCorr_n$ contains two normalised correlation values of the current frame n.

$MaxEnergy_{buf}$ is the maximum value of the buffer containing energy values.

The energy buffer contains the last six values of the current and previous frames (20 ms).

$lph_n$ indicates the spectral tilt.

NoMtcx is the flag indicating to avoid TCX coding with a long frame length (80 ms), if TCX excitation is selected.

If a VAD flag is set, denoting an active audio signal, and a first excitation method has been determined in the first stage selection module as ACELP, the first excitation method determination is verified according to following algorithm where the method can be switched to TCX.

```
if (LagDif_buf < 2)
   if (NormCorr_n < 0.80 and SD_n < 0.1)
      Mode = TCX_MODE;
if (lph_n > 200 and SD_n < 0.1)
   Mode = TCX_MODE
```

If VAD flag is set in the current frame and VAD flag has been set to zero in at least one of frames in the previous super-frame (a superframe is 80 ms long and comprises 4 frames, each 20 ms in length) and the mode has been selected as TCX mode, the usage of TCX excitation resulting in 80 ms frames, TCX80, is disabled (the flag NoMtcx is set).

```
if (vadFlag_old == 0 and vadFlag == 1 and Mode == TCX_MODE))
   NoMtcx = NoMtcx +1
```

If VAD flag is set and the first excitation selection method has been determined as uncertain (TCX_OR_ACELP) or TCX, the first excitation selection method is verified according to following algorithm.

```
if (Gain_n − NormCorr_n < 0.006 and NormCorr_n > 0.92 and Lag_n > 21)
   DFTSum = 0;
   for (i=1; i<40; i++) {
      DFTSum = DFTSum + mag[i];
   if (DFTSum > 95 and mag[0] < 5) {
      Mode = TCX_MODE;
   else
      Mode = ACELP_MODE;
      NoMtcx = NoMtcx +1
```

$vadFlag_{old}$ is the VAD flag of the previous frame and vadFlag is the VAD flag of the current frame.

NoMtcx is the flag indicating to avoid TCX excitation with long frame length (80 ms), if TCX excitation method is selected.

Mag is a discete Fourier transformed (DFT) spectral envelope created from LP filter coefficients, Ap, of the current frame.

DFTSum is the sum of first 40 elements of the vector mag, excluding the first element (mag(0)) of the vector mag.

The frame after the second stage selection module 210 is then transmitted onto the excitation generation module 212, which encodes the frame received from LTP analysis module 208 together with parameters received from the previous modules using one the excitation methods selected at the second or first stage selection modules 210 or 204. The encoding is controlled by the excitation selection module 216.

The frame output by excitation generation module 212 is an encoded frame represented by the parameters determined by the LPC analysis module 206, the LTP analysis module 208 and the excitation generation module 212. The encoded frame is output via a third stage selection module 214.

If ACELP excitation was used to encode the frame, then the encoded frame passes straight through the third stage selection module 214 and is output directly as encoded frame 107. However, if TCX excitation was used to encode the frame, then the length of the encoded frame must be selected depending on the number of previously selected ACELP frames in the super-frame, where a super-frame has a length of 80 ms and it comprises 4×20 ms frames. In other words, the length of the encoded TCX frame depends on the number of ACELP frames in the preceding frames.

The maximum length of a TCX encoded frame is 80 ms and can be made up of a single 80 ms TCX encoded frame (TCX80), 2×40 ms TCX encoded frames (TCX40) or 4×20 ms TCX encoded frames (TCX20). The decision as to how to encode the 80 ms TCX frame is made using the third stage selection module 214 by the excitation selection module 216 and is dependent on the number of selected ACELP frames in the super frame.

For example, the third stage selection module 214 can measure the signal to noise ratio of the encoded frames from the excitation generation module 212 and select either 2×40 ms encoded frames or a single 80 ms encoded frame accordingly.

Third excitation selection stage is done only if the number of ACELP methods selected in first and second excitation selection stages is less than three (ACELP<3) within a 80 ms super-frame. Table 1 below shows the possible method combinations before and after third excitation selection stage.

In the third excitation selection stage, the frame length of TCX method is selected, for example, according to the SNR.

TABLE 1

| Method combinations in TCX | | | |
|---|---|---|---|
| Selected mode combination after 1st and 2nd stage excitation selection | Possible mode combination after 3rd stage excitation selection (ACELP = 0, TCX20 = 1, TCX40 = 2 and TCX80 = 3) | | |
| (TCX = 1 and ACELP = 0) | | | NoMTcx Flag |
| (0, 1, 1, 1) | (0, 1, 1, 1) | (0, 1, 2, 2) | |
| (1, 0, 1, 1) | (1, 0, 1, 1) | (1, 0, 2, 2) | |
| (1, 1, 0, 1) | (1, 1, 0, 1) | (2, 2, 0, 1) | |
| (1, 1, 1, 0) | (1, 1, 1, 0) | (2, 2, 1, 0) | |
| (1, 1, 0, 0) | (1, 1, 0, 0) | (2, 2, 0, 0) | |
| (0, 0, 1, 1) | (0, 0, 1, 1) | (0, 0, 2, 2) | |
| (1, 1, 1, 1) | (1, 1, 1, 1) | (2, 2, 2, 2) | 1 |
| (1, 1, 1, 1) | (2, 2, 2, 2) | (3, 3, 3, 3) | 0 |

The embodiments described thus select ACELP excitation for periodic signals with high long-term correlation, which may include speech signals, and transient signals. On the other hand, TCX excitation will be selected for certain kinds of stationary signals, noise-like signals and tone-like signals, which is more suited to handling and encoding the frequency resolution of such signals.

The selection of the excitation method in embodiments is delayed but applies to the current frame and therefore provides a lower complexity method of encoding a signal than in previously known arrangements. Also memory consumption of described method is considerably lower than in previously known arrangements. This is particularly important in mobile devices which have limited memory and processing power.

Furthermore, the use of parameters from the VAD module, LPC and LTP analysis modules results in a more accurate classification of the signal and therefore more accurate selection of an optimal excitation method for encoding the signal.

It should be noted that whilst the preceding discussion and embodiments refer to the AMR-WB+ codec, a person skilled in the art will appreciate that the embodiments can equally be to other codecs wherein more than one excitation method can be used, as alternative embodiments and as additional embodiments.

Furthermore, whilst the above embodiments describe using one of two excitation methods, ACELP and TCX, a person skilled in the art will appreciate that other excitation methods could also be used instead of and as well as those described in alternative and additional embodiments.

The encoder could also be used in other terminals as well as mobile terminals, such as a computer or other signal processing device.

It is also noted herein that while the above describes exemplifying embodiments of the invention, there are several variations and modifications which may be made to the disclosed solution without departing from the scope of the present invention as defined in the appended claims.

The invention claimed is:

1. A method comprising:

calculating, in an encoder, a first set of parameters associated with at least one frame of a received signal, wherein said first set of parameters comprises parameters based on energy levels of a plurality of frequency bands associated with the at least one frame;

selecting, in a first stage, one of algebraic code excited linear prediction excitation, transform coding excitation or an uncertain mode based at least in part on predetermined conditions associated with the first set of parameters;

calculating a second set of parameters associated with the at least one frame;

selecting, in a second stage, one of algebraic code excited linear prediction excitation and transform coding excitation based at least in part on the second set of parameters and whether in the first stage the uncertain mode is selected; and encoding the frame using the selected one of algebraic code excited linear prediction excitation and the transform coding excitation from the second stage.

2. The method according to claim 1, wherein if algebraic code excited linear prediction excitation has been selected in the first stage, the selecting in the second stage comprises reselecting algebraic code excited linear prediction excitation or selecting instead transform coding excitation according to a first algorithm.

3. The method according to claim 2, wherein the one of algebraic code excited linear prediction excitation, transform coding excitation or an uncertain mode comprises a first mode corresponding to the first excitation method and a second mode corresponding to the second excitation method.

4. The method according to claim 1, wherein if transform coding excitation or uncertain mode has been selected in the first stage, the selecting in the second stage comprises reselecting transform coding excitation or selecting instead algebraic code excited linear prediction excitation according to a second algorithm.

5. The method according to claim 1, wherein if the uncertain mode has been selected in the first stage, the selecting in the second stage comprises selecting one of algebraic code excited linear prediction excitation and transform coding excitation according to a third algorithm.

6. The method according to claim 1, wherein, when the frame is encoded using transform coding excitation the method further comprises:

selecting a length of the at least one frame to be encoded using the transform coding excitation based on the selecting at the first stage and the second stage.

7. The method according to claim 6, wherein the selection of the length of the at least one frame to be encoded is selected dependent on a signal to noise ratio of the frame.

8. The method according to claim 1, wherein the method further comprises encoding at least one of the at least one frame using an adaptive multi rate-wideband plus encoder.

9. The method according to claim 1, wherein the at least one frame comprises an audio frame.

10. The method according to claim 9, wherein the audio frame comprises speech or non-speech.

11. The method according to claim 10, wherein the non-speech comprises music.

12. The method according to claim 1, comprising determining if the received signal is an active signal.

13. The method according to claim 12, wherein said determining if the received signal is an active signal is performed based on said first set of parameters.

14. The method according to claim 12, wherein said first set of parameters are obtained from a filter bank.

15. The method according to claim 1, wherein the one of algebraic code excited linear prediction excitation, transform coding excitation or an uncertain mode comprises a first mode corresponding to a first excitation method and a second mode corresponding to a second excitation method.

16. The method according to claim 15, wherein the one of algebraic code excited linear prediction excitation, transform coding excitation or an uncertain mode further comprises a third mode corresponding to an undetermined state.

17. The method according to claim 1, wherein said first set of parameters are obtained from a filter bank.

18. The method according to claim 1, wherein the second set of parameters comprises at least one of spectral parameters, long term prediction parameters and correlation parameters associated with the frame.

19. An apparatus comprising:

at least one processor; and at least one memory including computer program code, the at least one memory and the computer program code configured to, with the at least one processor, cause the apparatus at least to calculate a first set of parameters associated with at least one frame of a received signal, wherein said first set of parameters comprises parameters based on energy levels of a plurality of frequency bands associated with the at least one frame;

select, in a first stage, one of algebraic code excited linear prediction excitation, transform coding excitation or an uncertain mode based at least in part on predetermined conditions associated with the first set of parameters;

calculate a second set of parameters associated with the at least one frame;

select, in a second stage, one of algebraic code excited linear prediction excitation and transform coding excitation based at least in part on the second set of parameters and whether in the first stage the uncertain mode is selected; and encode the frame using the selected one of algebraic code excited linear prediction excitation and the transform coding excitation from the second stage.

20. The apparatus according to claim 19, wherein, if algebraic code excited linear prediction excitation has been selected in the first stage, the at least one memory and the computer program code are further configured, with the at least one processor, to cause the apparatus to reselect, in the second stage, algebraic code excited linear prediction excitation or select instead transform coding excitation according to a first algorithm.

21. The apparatus according to claim 20, wherein the one of algebraic code excited linear prediction excitation, transform coding excitation or an uncertain mode comprises a first mode corresponding to the first excitation method and a second mode corresponding to the second excitation method.

22. The apparatus according to claim 19, wherein, if transform coding excitation or uncertain mode has been selected in the first stage, the at least one memory and the computer program code are further configured, with the at least one processor, to cause the apparatus to reselect, in the second stage, transform coding excitation or select instead algebraic code excited linear prediction excitation according to a second algorithm.

23. The apparatus according to claim 19, wherein, if the uncertain mode has been selected in the first stage, the at least one memory and the computer program code are further configured, with the at least one processor, to cause the apparatus to select, in the second stage, one of algebraic code excited linear prediction excitation and transform coding excitation according to a third algorithm.

24. The apparatus according to claim 19 wherein, when the frame is encoded using transform coding excitation, the at least one memory and the computer program code are configured, with the at least one processor, to cause the apparatus to select a length of the at least one frame to be encoded using the transform coding excitation based on the selection at the first stage and the second stage.

25. The apparatus according to claim 24, wherein the at least one memory and the computer program code, with the at least one processor, are configured to select a length of the at least one frame to be encoded based on a signal to noise ratio of the frame.

26. The apparatus according to claim 19, wherein the apparatus comprises an adaptive multi rate-wideband plus encoder.

27. The apparatus according to claim 19, wherein the at least one frame comprises an audio frame.

28. The apparatus according to claim 27, wherein the audio frame comprises speech or non-speech.

29. The apparatus according to claim 28, wherein the non-speech comprises music.

30. The apparatus according to claim 19, wherein the at least one memory and the computer program code are further configured, with the at least one processor, to cause the apparatus to determine if the received signal is an active signal.

31. The apparatus according to claim 30, wherein the at least one memory and the computer program code are further configured, with the at least one processor, to cause the apparatus to determine if the received signal is an active signal based on said first set of parameters.

32. The apparatus according to claim 30, wherein said first set of parameters are obtained from a filter bank.

33. The apparatus according to claim 19, wherein the one of algebraic code excited linear prediction excitation, transform coding excitation or an uncertain mode comprises a first mode corresponding to a first excitation method and a second mode corresponding to a second excitation method.

34. The apparatus according to claim 19, wherein said first set of parameters are obtained from a filter bank.

35. The apparatus according to claim 19, wherein the second set of parameters comprises at least one of spectral parameters, long term prediction parameters and correlation parameters associated with the frame.

36. A terminal comprising:

at least one processor; and at least one memory including computer program code, the at least one memory and the computer program code configured to, with the at least one processor, cause the apparatus at least to calculate a first set of parameters associated with at least one frame of a received signal, wherein said first set of parameters comprises parameters based on energy levels of a plurality of frequency bands associated with the at least one frame;

select, in a first stage, one of algebraic code excited linear prediction excitation, transform coding excitation or an uncertain mode based at least in part on predetermined conditions associated with the first set of parameters;

calculate a second set of parameters associated with the at least one frame;

select, in a second stage, one of algebraic code excited linear prediction excitation and transform coding excitation based at least in part on the second set of parameters and whether in the first stage the uncertain mode is selected; and encode the frame using the selected one of algebraic code excited linear prediction excitation and the transform coding excitation from the second stage.

37. The terminal according to claim 36, wherein said terminal is a signal processing device.

38. The terminal according to claim 36, wherein said terminal is a mobile terminal.

39. The terminal according to claim 36, wherein said first set of parameters are obtained from a filter bank.

40. A computer program, embodied on a non-transitory computer readable medium, said computer program being configured to control a processor to perform a method comprising:

calculating a first set of parameters associated with at least one frame of a received signal, wherein said first set of parameters comprises parameters based on energy levels of a plurality of frequency bands associated with the at least one frame;

selecting, in a first stage, one of algebraic code excited linear prediction excitation, transform coding excitation or an uncertain mode based at least in part on predetermined conditions associated with the first set of parameters;

calculating a second set of parameters associated with the at least one frame;

selecting, in a second stage, one of algebraic code excited linear prediction excitation and transform coding excitation based at least in part on the second set of parameters and whether in the first stage the uncertain mode is selected; and encoding the frame using the selected one of algebraic code excited linear prediction excitation and the transform coding excitation from the second stage.

41. The computer program according to claim 40, wherein said first set of parameters are obtained from a filter bank.

42. An apparatus comprising:

first calculating means for calculating a first set of parameters associated with at least one frame of the received signal, wherein said first set of parameters comprises parameters based on energy levels of a plurality of frequency bands associated with the at least one frame;

first selecting means for selecting one of algebraic code excited linear prediction excitation, transform coding excitation or an uncertain mode based at least in part on predetermined conditions associated with the first set of parameters;

second calculating means for calculating a second set of parameters associated with the at least one frame;

second selecting means for selecting one of algebraic code excited linear prediction excitation and transform coding excitation based at least in part on the second set of parameters and whether in the first stage the uncertain mode is selected; and encoding means for encoding the frame using the selected one of algebraic code excited linear prediction excitation and the transform coding excitation from the second selecting means.

43. The apparatus according to claim 42, wherein said first set of parameters are obtained from a filter bank.

* * * * *